US008109057B2

(12) United States Patent
Stark

(10) Patent No.: US 8,109,057 B2
(45) Date of Patent: Feb. 7, 2012

(54) TOWER FOUNDATION SYSTEM

(76) Inventor: Daniel Stark, Washougal, WA (US)

( * ) Notice: Subject to any disclaimer, the term of this patent is extended or adjusted under 35 U.S.C. 154(b) by 369 days.

(21) Appl. No.: 12/041,557

(22) Filed: Mar. 3, 2008

(65) Prior Publication Data

US 2009/0217607 A1 Sep. 3, 2009

(51) Int. Cl.
*E02D 27/00* (2006.01)

(52) U.S. Cl. ..... 52/297; 52/298; 52/704; 52/158; 52/165; 405/231; 405/232; 405/244; 248/679; 248/530; 248/156

(58) Field of Classification Search ..... 52/40, 298, 52/299, 704, 153, 155, 156, 157, 158, 159, 52/245, 247, 294, 295, 296, 297, 169.13, 52/170, 165; 416/DIG. 6; 405/231, 232, 405/244, 249, 250, 251; 248/678, 679, 530, 248/156

See application file for complete search history.

(56) References Cited

U.S. PATENT DOCUMENTS 2,036,771 A * 4/1936 Pfistershammer ..... 52/298
2,679,911 A * 6/1954 Bhend ..... 52/298
2,945,659 A * 7/1960 Mcdonald ..... 52/40
3,031,041 A * 4/1962 Pfaff, Jr. ..... 52/298
3,131,543 A * 5/1964 Dougherty ..... 405/251
3,514,911 A * 6/1970 Preradovich ..... 52/165
3,563,502 A * 2/1971 Dayson ..... 52/98
3,838,547 A * 10/1974 Meisberger ..... 52/295
3,951,556 A 4/1976 Strizki
4,070,837 A * 1/1978 Sato ..... 52/297
4,218,858 A * 8/1980 Legler ..... 52/165
4,232,846 A 11/1980 Bressani
4,269,010 A * 5/1981 Glass ..... 52/154
4,603,520 A 8/1986 Deike
4,779,389 A 10/1988 Landers
4,918,891 A 4/1990 Gerszewski
5,060,435 A * 10/1991 Bogdanow ..... 52/292
5,066,168 A * 11/1991 Holdeman ..... 405/249

(Continued)

FOREIGN PATENT DOCUMENTS

JP 2004293210 10/2004

OTHER PUBLICATIONS

PCT/US2008/055713 International Search Report and the Written Opinion, Jul. 28, 2008.

(Continued)

*Primary Examiner* — Robert Canfield
*Assistant Examiner* — Matthew Gitlin
(74) *Attorney, Agent, or Firm* — Kunzler Needham Massey & Thorpe

(57) ABSTRACT

Described herein are various embodiments of a tower foundation system for an above-ground tower. For example, according to one representative embodiment, a tower for supporting a structure above the ground includes a foundation and a second support column section. The foundation includes a first support column section and a plurality of arms that extend radially outward away from an outer surface of the first support column. Additionally, the foundation includes a plurality of elongate anchors coupled to the plurality of arms. The first and second support column sections include each include a plurality of engagement elements engageable with each other to splice the first and second support column sections together. More specifically, the second support column section is insertable into and rests upon the first support column section such that the plurality of engagement elements engage each other.

16 Claims, 8 Drawing Sheets

U.S. PATENT DOCUMENTS

| | | | | |
|---|---|---|---|---|
| 5,133,164 | A * | 7/1992 | Legler | 52/165 |
| 5,175,973 | A | 1/1993 | Owen et al. | |
| 5,333,436 | A | 8/1994 | Noble | |
| 5,355,642 | A * | 10/1994 | Palamarz | 52/73 |
| 5,524,408 | A | 6/1996 | Richey | |
| 5,596,845 | A | 1/1997 | Strizki | |
| 5,749,189 | A * | 5/1998 | Oberg | 52/298 |
| 5,772,172 | A | 6/1998 | Sampedro et al. | |
| 5,815,994 | A * | 10/1998 | Knight et al. | 52/170 |
| 5,826,387 | A | 10/1998 | Henderson et al. | |
| 5,961,253 | A * | 10/1999 | Okawa | 405/239 |
| 5,984,587 | A * | 11/1999 | Odle | 405/244 |
| 6,151,860 | A | 11/2000 | Reisdorff | |
| 6,267,127 | B1 * | 7/2001 | Doreste | 135/15.1 |
| 6,397,545 | B1 | 6/2002 | Fanucci et al. | |
| 6,446,411 | B2 | 9/2002 | Natelli, Jr. | |
| 6,532,700 | B1 | 3/2003 | Maliszewski et al. | |
| 6,665,990 | B1 | 12/2003 | Cody et al. | |
| 6,705,058 | B1 | 3/2004 | Foust et al. | |
| 6,799,401 | B1 * | 10/2004 | Legler | 52/169.13 |
| 6,807,790 | B2 | 10/2004 | Strickland et al. | |
| 6,851,231 | B2 | 2/2005 | Tadros et al. | |
| 6,908,250 | B2 | 6/2005 | Moffatt | |
| 7,004,683 | B1 * | 2/2006 | Rupiper | 405/229 |
| 7,302,778 | B2 | 12/2007 | MacMillan | |
| 2003/0033281 | A1 | 2/2003 | Ritz | |
| 2003/0145554 | A1 | 8/2003 | Young | |
| 2004/0047693 | A1 * | 3/2004 | Nishiwaki et al. | 405/250 |
| 2004/0163336 | A1 * | 8/2004 | Hsu | 52/157 |
| 2005/0166485 | A1 * | 8/2005 | Sugimoto et al. | 52/155 |
| 2006/0033336 | A1 | 2/2006 | Pulver | |
| 2007/0125737 | A1 | 6/2007 | O'Reilly | |
| 2008/0017226 | A1 * | 1/2008 | Nobert et al. | 135/16 |
| 2008/0236073 | A1 * | 10/2008 | Bagepalli et al. | 52/292 |
| 2009/0090836 | A1 * | 4/2009 | Harris | 248/530 |
| 2009/0211174 | A1 * | 8/2009 | Henderson et al. | 52/40 |

OTHER PUBLICATIONS

Campbell, R. et al., "Use of Fins on Piles for Increase Tension Capacity (Spin-Fin Piles) Final Report," Report No. FHWA-AK-RD-87-16, Report date: Feb. 1987.

"Tower Foundation Systems," Real Developments, Inc., http://www.real-developmentsinc.com/new.htm, (visited Apr. 24, 2007).

"Wind Turbine Foundations," Barr, http://www.barr.com/PDFs/Factsheets/wind_turbine_foundations.pdf, (Visited Apr. 24, 2007).

"Wind Power Services," Barr, http://www.barr.com/PDFs/Factsheets/windpower_serv.pdf, (Visited Apr. 24, 2007).

Satari, M., et al., "Vibration Based Wind Turbine Tower Foundation Design Utilizing Soil-Foundation-Structure Interaction," at http://www.coffman.com/documents/news/industry_articles/la_2008/windtowerpaperwcee.pdf (last visited Jan. 21, 2009).

* cited by examiner

TOWER FOUNDATION SYSTEM

FIELD

This disclosure relates to towers for supporting structures, such as billboards, and more particularly, to a tower foundation system.

BACKGROUND

Towers for supporting large structures, such as billboards, wind turbines, fluid containers, communication, power, and other transmission devices, lighting, freeway signs, etc., include support columns that must be firmly secured to the ground to resist overturning forces on the towers. The support columns are secured to the ground by foundations or footings. To resist such overturning forces, foundations must be able to maintain support columns in an upright position despite overturning forces that may act on the columns.

Many conventional tower foundations include a footing embedded within a cavity that is formed in the ground. Typical footings are made mainly of concrete. The support column is secured to the footing by maintaining the column in place within the cavity and pouring the concrete around the column. Over time, the concrete hardens to secure the column to the footing.

Because of the need to resist overturning forces and potential inconsistencies in the ability of the soil near the surface to support vertical and lateral forces, the footing, and thus the cavity, must extend a substantial distance and occupy a substantial amount of space below the surface. For example, some conventional foundations can extend about 30-45 feet below the surface and occupy a space up to about 5,000 cubic feet.

To form a sub-surface cavity large enough to accommodate conventional footings and columns, a substantial amount of earth must be excavated or removed. The larger the excavation, the more labor, materials, and equipment necessary to form the excavation. For example, a crane is required to hold the support column in place while the concrete hardens. As the amount of concrete necessary to form the footing increases, the time it takes for the concrete to harden and the support column to remain in place increases. The longer the support column has to be held in place by the crane, the higher the cost for use and scheduling of the crane. In addition to increased costs for a crane, larger excavation pits result in cost increases associated with auguring and digging equipment for removing earth from the excavation cavity or pit, and water pumping equipment for removing water from pits deeper than the water table. Also, large foundations result in increased costs associated with additional concrete and concrete transportation vehicles.

Relatively large towers often are installed in two stages. First, a footing securing a first portion of the support column is installed in the ground. Second, a remaining second portion of the support column is coupled or spliced to the first portion to form the completed support column. Conventionally, splicing two support column portions together includes bolting a gusseted flange of the first portion to a gusseted flange of the second portion or welding the first portion to the second portion. Each approach requires manually intensive and costly fastening or welding at the fabrication and/or installation site. Further, the two portions of the support column often are out-of-round making splicing difficult.

After installations, structural elements of a tower foundation may fail or tower foundations may no longer be needed in a particular location. Many conventional tower foundations do not allow for easy removal of failed components or the entire tower foundation. Additionally, most conventional tower foundations are not reusable after removal from an installation site. Also, many conventional tower foundations do not allow for post-installation adjustment should a tower be installed incorrectly, such as being vertically misaligned.

SUMMARY

The subject matter of the present application has been developed in response to the present state of the art, and in particular, in response to the problems and needs in the art that have not yet been fully solved by currently available tower foundations and support column splicing techniques. Accordingly, the subject matter of the present application has been developed to provide a tower foundation and splicing system that overcomes at least some shortcomings of the prior art.

According to some embodiments, a tower foundation is provided having deep sub-surface attachment anchors, but requires either no excavation pit or a shallow excavation pit formed in the ground. Further, in certain embodiments, the tower foundation does not include concrete as the primary support for lateral, vertical load, and overturning forces. Accordingly, in some embodiments, the tower foundation described herein overcomes many of the deficiencies associated with deep exaction pits, unstable ground near the surface, and installation delays described above.

Additionally, in some embodiments, a splicing system is provided that allows a secure and exact coupling between two or more support column sections without tightening fasteners or welding at the installation site and that accommodates inconsistencies in the cross-sectional shapes of the sections to be spliced.

Also, the tower foundation, or components of the foundation, can be easily removed after installation and reused at the same or other installation sites according to some embodiments. Further, in some implementations, the tower foundation allows post-installation adjustment.

For example, according to one representative embodiment, a shallow excavation tower foundation for coupling a tower to the ground includes a support column with an upper end, a lower end and an outer surface that is intermediate the upper and lower ends. The support column extends in a first direction between the upper and lower ends. The shallow excavation tower also includes a plurality of arms each having a first and second end. Each arm is coupled to the outer surface of the support column at the first end and extends radially outward away from the outer surface. Further, the shallow excavation tower has a plurality of elongate anchors each having an upper end portion and a lower end portion, the upper end portion of each anchor being coupled to the second end of a respective one of the plurality of arms and the lower end portion being embeddable within the ground at a location substantially away from the lower end of the support column. In certain instances, the support column can be substantially hollow and define an inner surface, and the tower foundation can additionally include a stiffener plate positioned within and coupled to the inner surface of the support column.

In some implementations, a height of the arm is greater than a width of the arm. For clarity, the height of the arm extends substantially parallel to the first direction and the width of the arm extends substantially perpendicular to the first direction.

According to some implementations, the second end of each of the plurality of arms includes an anchor attachment system, which includes a hollow tubular element extending substantially in the first direction. The upper end portion of each of the plurality of anchors can be coupleable to the hollow tubular element. In certain implementations, the tower foundation includes spaced-apart upper and lower plates that are coupled to the outer surface of the support column and the hollow tubular elements. The upper and lower plates can be substantially perpendicular to the first direction.

In some instances, each of the anchor attachment systems also includes first and second end caps. The first end cap can be sealingly engageable with a first end of a respective hollow tubular element and the second end cap can be sealingly engageable with a second end of the respective hollow tubular element. The first end cap can have a connecting portion that extends through the hollow tubular member to couple the first end cap to the second end cap. The upper end portion of each of the plurality of anchors can be coupled to a respective one of the first and second end caps of a respective anchor attachment system. In certain instances, each of the hollow tubular members defines an inner diameter and the connecting portions of each of the first end caps define an outer diameter. The inner diameters of the hollow tubular members can be substantially larger than the outer diameters of the connecting portions of the first end caps such that each connecting portion can be angled relative to the tubular member at any of various angles corresponding to an angle defined between the respective anchor and the tubular member.

According to some implementations, the support column of the tower foundation includes a first support column. The first support column has an inner surface defining a hollow interior, a first plate having a plurality of spaced-apart first engagement elements, and a second plate defining an aperture and having a plurality of spaced-apart second engagement elements. The first plate can be secured to the inner surface of the first support column within the hollow interior at a location spaced below the upper end of the first support column and the second plate can be secured proximate the upper end of the support column. The plurality of spaced-apart first and second engagement elements can be configured to receive a plurality of spaced-apart third and fourth engagement elements of a second support column to splice the first and second support columns together without welding or tightening the first and second support columns together.

According to another embodiment, a splicing system for splicing together sections of a support column for an above ground tower can include a first column section with a first sidewall having an inner surface that defines a hollow interior. The first column section also includes a first plate having a plurality of spaced-apart first engagement elements and a second plate defining an aperture and having a plurality of spaced-apart second engagement elements. The first plate is secured to the inner surface and positioned within the hollow interior and the second plate is secured to the first sidewall at a location above the first plate.

The splicing system also includes a second column section that includes a second sidewall having a lower end and an outer surface. The second column section also includes a third plate with a plurality of spaced-apart third engagement elements and a fourth plate having a plurality of spaced-apart fourth engagement elements. The third plate is secured to the second sidewall proximate the lower end of the second column section and the fourth plate being secured to the outer surface of the sidewall at a location above the third plate. The first and third plates can be substantially disk shaped and the second and fourth plates can be substantially annular shaped.

The second column section is insertable into the hollow interior of the first column section and through the aperture of the second plate such that (i) the first plate supports the third plate and the second plate supports the fourth plate and (ii) the plurality of third engagement elements each engage a respective one of the plurality of first engagement elements and the plurality of fourth engagement elements each engage a respective one of the plurality of second engagement elements to splice the second column section to the first column section.

In certain implementations, the second column section is spliceable with the first column section without welding or tightening the first and second column sections together. In yet some implementations, the sidewall of the first column section includes an upper end with the second plate being secured to the upper end. When the difference between a radius of the second column section and a radius of the first column section is less than a predetermined threshold, a substantial portion of the second plate can extend outwardly away from the outer surface of the first column section. Alternatively, when a difference between a radius of the second column section and a radius of the first column section is more than a predetermined threshold, a substantial portion of the second plate extends can inwardly away from the outer surface of the first column section.

According to some implementations, the plurality of spaced-apart first and second engagement elements of the first column section each comprise a plurality of spaced-apart apertures. The plurality of spaced-apart third and fourth engagement elements of the second column section can each comprise a plurality of spaced-apart pegs or pins. The plurality of spaced-apart pegs of the second column section can be insertable into respective ones of the plurality of spaced-apart apertures of the first column section to engage the plurality of spaced-apart pegs with the plurality of spaced apart apertures. Of course in other implementations, the plurality of spaced-apart first and second engagement elements can be pegs and the plurality of spaced-apart third and fourth engagement elements can be apertures. Also, in some implementations, the first engagement elements can be pegs, the second engagement elements can be apertures, the third engagement elements can be apertures, and the fourth engagement elements can be pegs.

In certain instances, the aperture of the second plate has a first diameter and the outer surface of the second sidewall has a second diameter, the first diameter being about equal to the second diameter. Additionally, in some implementations, the distance between the first and second plate can be substantially equal to the distance between the third and fourth plate.

In one exemplary implementation, the first plate is coupled to the inner surface of the first column section by a plurality of shelves each fixed to the inner surface of the first column section. The first plate can be mountable to the shelves in any of various positions relative to the inner surface of the first column.

According to some implementations, the splicing system also includes a plurality of arms each having a first and second end. Each arm can be coupled to an outer surface of the first column section at the first end and extend radially outward away from the outer surface. The splicing system can further include a plurality of elongate anchors each having an upper end portion and a lower end portion. The upper end portion of each anchor can be coupled to the second end of a respective one of the plurality of arms and the lower end portion can be embeddable within the ground at a location substantially away from the first column section.

According to another embodiment, a tower for supporting a structure above the ground includes a foundation and a second support column section.

The foundation includes a first support column section that has a first sidewall with an inner surface defining a hollow interior and an outer surface. The first support column section also includes a first plate with a plurality of spaced-apart first engagement elements and a second plate defining an aperture and having a plurality of spaced-apart second engagement elements. The first plate is secured to the inner surface and positioned within the hollow interior and the second plate is secured to the first sidewall at a location above the first plate. The foundation also includes a plurality of arms that each has a first and second end. Each arm is coupled to the outer surface of the first support column section at the first end and extends radially outward away from the outer surface. Additionally, the foundation includes a plurality of elongate anchors that each has an upper end portion and a lower end portion. The upper end portion of each anchor is coupled to the second end of a respective one of the plurality of arms and the lower end portion is embeddable within the ground at a location substantially away from the lower end of the first support column section.

The second support column section includes a second sidewall having a lower end and an outer surface. The second column section also includes a third plate having a plurality of spaced-apart third engagement elements and a fourth plate having a plurality of spaced-apart fourth engagement elements. The third plate is secured to the second sidewall proximate the lower end and the fourth plate is secured to the outer surface of the sidewall at a location above the third plate. The second support column section is also insertable into the hollow interior of the first support column section and through the aperture of the second plate such that (i) the first plate supports the third plate and the second plate supports the fourth plate and (ii) the plurality of third engagement elements each engage a respective one of the plurality of first engagement elements and the plurality of fourth engagement elements each engage a respective one of the plurality of second engagement elements to splice the second support column section to the first support column section.

According to yet another embodiment, a method for installing a tower used to support a structure above the ground includes embedding a plurality of elongate anchors having upper and lower end portions into the ground such that the upper end portions are accessible above the ground and the lower end portions are embedded a first distance below the ground. The method also includes providing a concreteless foundation portion that includes (i) a support column having an outer surface intermediate an upper and lower end and (ii) a plurality of arms each having a first and second end. Each arm is coupled to the outer surface of the support column at the first end and extends radially outward away from the outer surface. In certain instances, the first distance is below the lower end of the support column. The method further includes securing the upper end portions of each of the plurality of elongate anchors to the second end of a respective one of the plurality of arms.

In some implementations, the second ends of the plurality of arms each include a substantially vertical tubular member that has a first upper end and a second lower end. The action of securing the upper end portions of each of the plurality of elongate anchors to the second end of a respective one of the plurality of arms can include attaching each upper end portion of the plurality of elongate anchors to one of a plurality of lower cap members. The action of securing can also include attaching one of a plurality of upper cap members to a respective one of the plurality of lower cap members and the upper end portion of the corresponding attached elongate anchor such that at least a portion of at least one of the upper and lower cap members extends through the respective tubular member. The action of securing can also include securing each upper cap member against the upper end of the respective tubular member and each lower cap member against the lower end of the respective tubular member.

According to yet some implementations, the support column can include a first support column section that has a hollow interior, a first plate having a plurality of spaced-apart first engagement elements and a second plate defining an aperture and having a plurality of spaced-apart second engagement elements. The first plate is secured within the hollow interior and the second plate is secured to the first support column at a location above the first plate. The method can further include providing a second support column section that has an outer surface and includes a third plate having a plurality of spaced-apart third engagement elements and a fourth plate having a plurality of spaced-apart fourth engagement elements. The fourth plate is secured to the outer surface of the sidewall at a location above the third plate. The method also includes lowering the second support column section into the hollow interior of the first support column section until the (i) the first plate supports the third plate and the second plate supports the fourth plate and (ii) the plurality of third engagement elements each engage a respective one of the plurality of first engagement elements and the plurality of fourth engagement elements each engage a respective one of the plurality of second engagement elements to splice the second support column section to the first support column section.

Reference throughout this specification to features, advantages, or similar language does not imply that all of the features and advantages that may be realized with the subject matter of the present disclosure should be or are in any single embodiment. Rather, language referring to the features and advantages is understood to mean that a specific feature, advantage, or characteristic described in connection with an embodiment is included in at least one embodiment of the present disclosure. Thus, discussion of the features and advantages, and similar language, throughout this specification may, but do not necessarily, refer to the same embodiment.

Furthermore, the described features, advantages, and characteristics of the subject matter of the present disclosure may be combined in any suitable manner in one or more embodiments. One skilled in the relevant art will recognize that the subject matter may be practiced without one or more of the specific features or advantages of a particular embodiment. In other instances, additional features and advantages may be recognized in certain embodiments that may not be present in all embodiments. These features and advantages will become more fully apparent from the following description and appended claims, or may be learned by the practice of the subject matter as set forth hereinafter.

BRIEF DESCRIPTION OF THE DRAWINGS

In order that the advantages of the subject matter may be more readily understood, a more particular description of the subject matter briefly described above will be rendered by reference to specific embodiments that are illustrated in the appended drawings. Understanding that these drawings depict only typical embodiments of the subject matter and are not therefore to be considered to be limiting of its scope, the subject matter will be described and explained with additional specificity and detail through the use of the drawings, in which.

DETAILED DESCRIPTION

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Additionally, instances in this specification where one element is "coupled" to another element can include direct and indirect coupling. Direct coupling can be defined as one element coupled to and in some contact with another element. Indirect coupling can be defined as coupling between two elements not in direct contact with each other, but having one or more additional elements between the coupled elements. Further, as used herein, securing one element to another element can include direct securing and indirect securing. Additionally, as used herein, "adjacent" does not necessarily denote contact. For example, one element can be adjacent another element without being in contact with that element.

Furthermore, the details, including the features, structures, or characteristics, of the subject matter described herein may be combined in any suitable manner in one or more embodiments. One skilled in the relevant art will recognize, however, that the subject matter may be practiced without one or more of the specific details, or with other methods, components, materials, and so forth. In other instances, well-known structures, materials, or operations are not shown or described in detail to avoid obscuring aspects of the disclosed subject matter.

Figure 1:
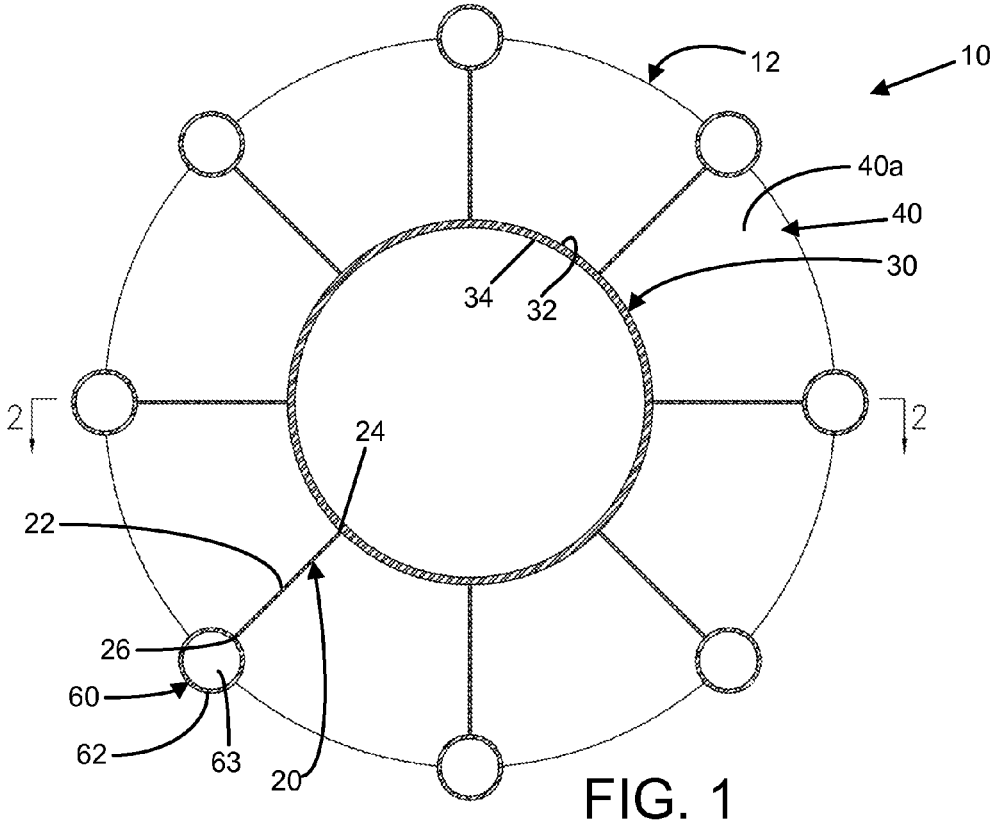
FIG. 1 is a top plan view of a tower foundation base according to one representative embodiment.

Referring to FIG. 1, a tower foundation 10 according to one representative embodiment is shown. The tower foundation 10 includes a plurality of arms 20 that are secured to and radially extend away from a central support column 30.

Figure 2:
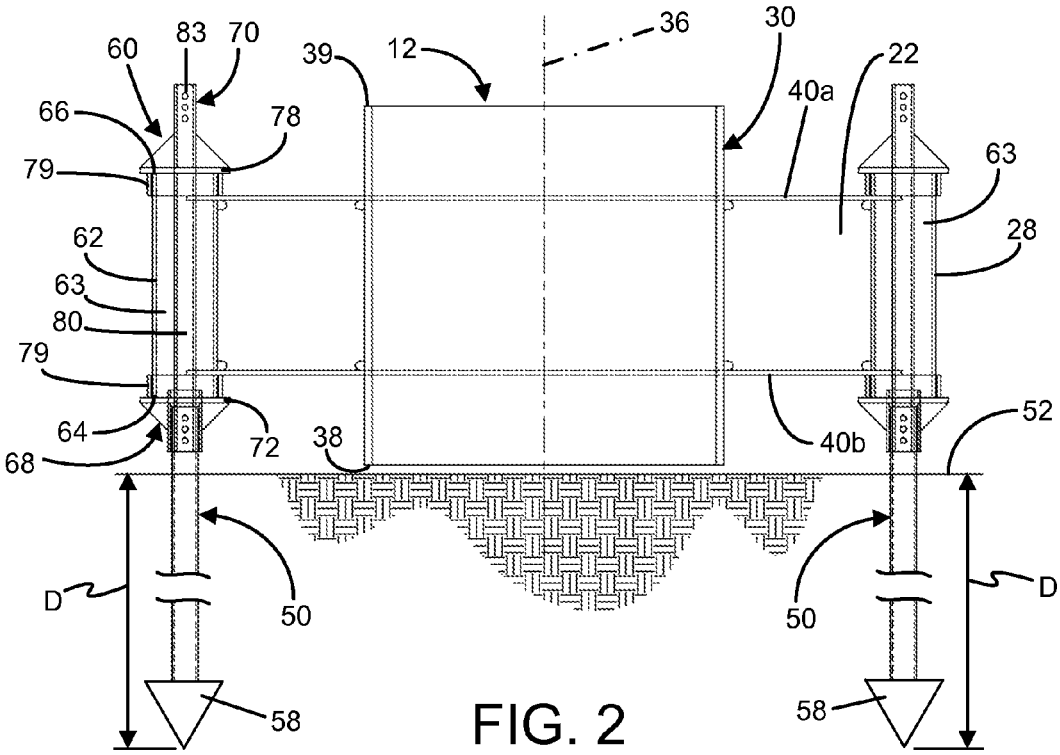
FIG. 2 is a cross-sectional side elevation view of the tower foundation base of FIG. 1 taken along the line 2-2 of FIG. 1 but shown with caps and anchors coupled to the base.

The central support column 30 includes a generally tubular shaped member member extending from a first lower end 38 to a second upper end 39 (see FIG. 2). The tubular shaped member of the central support column 30 defines an outer surface 32 and an inner surface 34. Preferably, the central support column 30 is made of a substantially rigid and durable material, such as steel.

The central support column 30 can have any of various lengths and cross-sectional shapes. For example, in some implementations, the central support column 30 can extend the entire length of the tower from the foundation 10 to the supported structure. More specifically, the central support column 30 can be a continuous, one-piece length of pipe secured to the foundation 10 at lower end portion and the supported structure at an opposite upper end portion. Alternatively, as shown in FIG. 2, the central support column 30 can comprise a section of the overall support column of the tower. For example, the central support column 30 can be a base section of the overall support column with one or more sections attached or spliced to the base section to complete the overall support column. In some instances, for ease in transportation, the central support column 30 can be a base section of the overall support column, and transported separate from the remaining section or sections of the overall support column. Likewise, in some instances, for ease in installation, as will be described in more detail below, the central support column 30 can be a base section and the foundation 10 can first be secured to the ground, with the remaining section or sections of the overall support column attached to the base section later.

Each of the arms 20 extends lengthwise from a first inner end 24 to a second outer end 26. The arms 20 can have any of various lengths. In certain instances, the length of the arms 20 depends at least partially on the above-ground height, weight, and size of the supported structure. In some exemplary implementations, the length of the arms 20 is between about 1 and about 10 feet. The first inner and second outer ends 24, 26 each extend substantially parallel to a height of the arms 20. The first inner end 24 is secured to an outer surface 32 of the support column 30 and the outer end 26 is coupled to to a housing 62 of an anchor attachment system 60. As shown in FIG. 2, in some implementations, the arms 20 are secured to the central support column 30 at a location intermediate the first lower end 38 and second upper end 39. In other words, the support column 30 can extend above and below the support arms. However, in other implementations, the arms 20 can be secured to the central support column 30 at any of various locations on the support column. For example, the arms 20 can be secured to the central support column 30 such that their upper edges are proximate, e.g., substantially flush with, the second upper end 39 of the support column, or their lower edges are proximate, e.g., substantially flush with, the first lower end 38 of the support column.

In some implementations, each arm 20 can be a relatively thin plate with a length and height that each is substantially greater than its width. The arms 20 are made of a substantially rigid and durable material, such as, for example, steel. Moreover, the arms 20 can be secured to the central support column 30 and coupled to the housing 62 by any of various coupling methods known in the art, such as, for example, welding, bracketing, bolting and/or fastening. Although the tower foundation 10 includes eight arms 20 equidistantly spaced about the circumference of the support column 30, in other implementations, the tower foundation can include more or less than eight arms and can be an equal distance from each other or variably distanced from each other about the support column.

In the illustrated embodiment of FIG. 1, the housing 62 is a generally tubular member extending in a generally vertical direction, i.e., substantially parallel to a central axis 36 of the central column 30 (see FIG. 2), between bottom and top ends 64, 66, respectively. However, in other embodiments, the housing 62 can be angled with respect to the central axis 36 of the column 30. The housing 62 defines a conduit or space 63 having at least a minimum cross-sectional dimension within the housing. For example, the tubular member of the housing 62 can be substantially cylindrical shaped with a conduit having at least a minimum diameter. Alternatively, the tubular member of the housing 62 can be shaped according to various shapes, such as a substantially rectangular or square shape in cross-section with a conduit having at least a minimum width, length and/or diagonal dimension.

The tower foundation 10 can also include a foundation stiffener 40 that couples the arms 20 and housings 62 together. The stiffener 40 includes two vertically spaced-apart stiffener plates 40*a*, 40*b* secured to the top and bottom edges of the arms 20, the outer surfaces of the housings 62 and the outer surface 32 of the support column 30. Accordingly, in some implementations, the distance between the stiffener plates 40*a*, 40*b* is approximately equal to the height of the arms. Although the stiffener plates 40*a*, 40*b* are shown secured to the top and bottom edges of the arms 20, in some embodiments, the stiffener plates 40*a*, 40*b* can be secured to the sides of the arms and the distance between the plates can be less than the height of the arms. Like the arms 20, the plates 40*a*, 40*b* can be relatively thin plates made of a substantially rigid and durable material, such as steel.

Referring to FIG. 2, the anchor attachment system 60 further includes bottom and top caps 68, 70, respectively. Generally, the bottom and top caps 68, 70 are securable to the bottom and top ends 64, 66 of respective housings 62 to effectively enclose or seal the conduit 63. The bottom cap 68 includes a sealing portion 72 and an anchor attachment portion 74. The sealing portion 72 includes a plate having a surface area greater than the cross-sectional area of the conduit 63. The anchor attachment portion 74 includes a tubular member with an inner diameter greater than an outer diameter of the anchor 50 (at an upper attachment end portion 56 of the anchor) and a plurality of apertures 76 (see FIG. 3). The apertures 76 are alignable with apertures 54 formed in the anchor 50.

Similar to the bottom cap 68, the top cap 70 includes a sealing portion 78 with a plate having a surface area greater than the cross-sectional area of the conduit 63. The top cap 70 also includes an anchor attachment portion 80 made of a tubular member with an outer diameter less than an inner diameter of the anchor 50 (at the upper attachment end portion 56 of the anchor) and a plurality of apertures 82 (see FIG. 3). Unlike the tubular member of the anchor attachment portion 74, the tubular member of the anchor attachment portion 80 is extendable from the upper end 66 of the housing 62, through the conduit 63, and through the lower end 64 of the housing. More generally, the anchor attachment portion 80 is longer than the anchor attachment portion 74. The plurality of apertures 82 are position proximate a lower end of the anchor attachment portion 80 and are alignable with the apertures 76 of the anchor attachment portion 74 and the apertures 54 of the anchor 50.

In the illustrated embodiment, the bottom and top caps 68, 70 each include a plurality of flanges 90 secured to and extending between the sealing portions 72, 78 and the anchor attachment portions 74, 80, respectively.

The anchor 50 includes an elongate rod-like element extending from the attachment end portion 56 accessible above the ground 52 to an embedment end portion 58 embeddable in the ground. The anchor 50 can be any of various anchors, piers, or piles known in the art having any of various working tensile and compressive load ratings. For example, depending on soil characteristics, the anchors 50 can have a working tensile and compressive load rating between about 50,000 pounds and about 100,000 pounds, and a lateral load rating of approximately 15,000 pounds. For example, in some implementations, the anchors 50 can include embedment end portions 58 that have helical screws (as shown), helical fins, spin fin, and/or other embedding elements. The type of embedment end portion 58 can be based at least partially on the geology at the installation site. For example, helical screws may provide better embedment within soil and geological formations of a particular type than helical fins, while helical fins provide better embedment within soil and geological formations of a different type than helical screws.

Referring to FIG. 2, the length of the anchors 50 can be predetermined such that the embedment end portion 58 is embedded within a geological formation a predetermined distance D below the ground, which, as shown, can correspond to the lower end 38 of the support column 30. Accordingly, based at least partially on the geology of the installation site, the length of the anchor 50 and the type of embedment end portion 58 can be selected such that the embedment end portion 58 embeds in a suitable formation at a suitable depth D for achieving a desirable resistance to overturning forces acting on the tower. In some embodiments, the tower foundation 10 is capable of resisting overturning forces up to about 20,000,000 ft-lb. In more specific implementations, the tower foundation 10 resists overturning forces up to between about 5,000,000 ft-lb and 7,000,000 ft-lb.

Generally, the embedment end portion 58 of the anchor 50 can be embedded at a greater depth D if more resistance to overturning forces is desired. Alternatively, or in addition, the embedment end portion 58 type that provides the strongest embedment with the type of formation at the desired depth D can be selected for achieving a greater resistance to overturning forces. In some instances, the embedment end portions 58 of the anchors 50 can be substantially below the support column 30, e.g., the depth D below the ground and support column can be between about 20 feet and about 30 feet. If necessary, the desired depth D can be any of various other lengths below 20 feet or above 30 feet. Further, in some instances, the outer diameter of the support column 30 can be between about 1 foot and about 10 feet. Accordingly, in some representative implementations, the ratio of the depth D and the outer diameter of the support column 30 is between about 2 and about 30.

Figure 3:
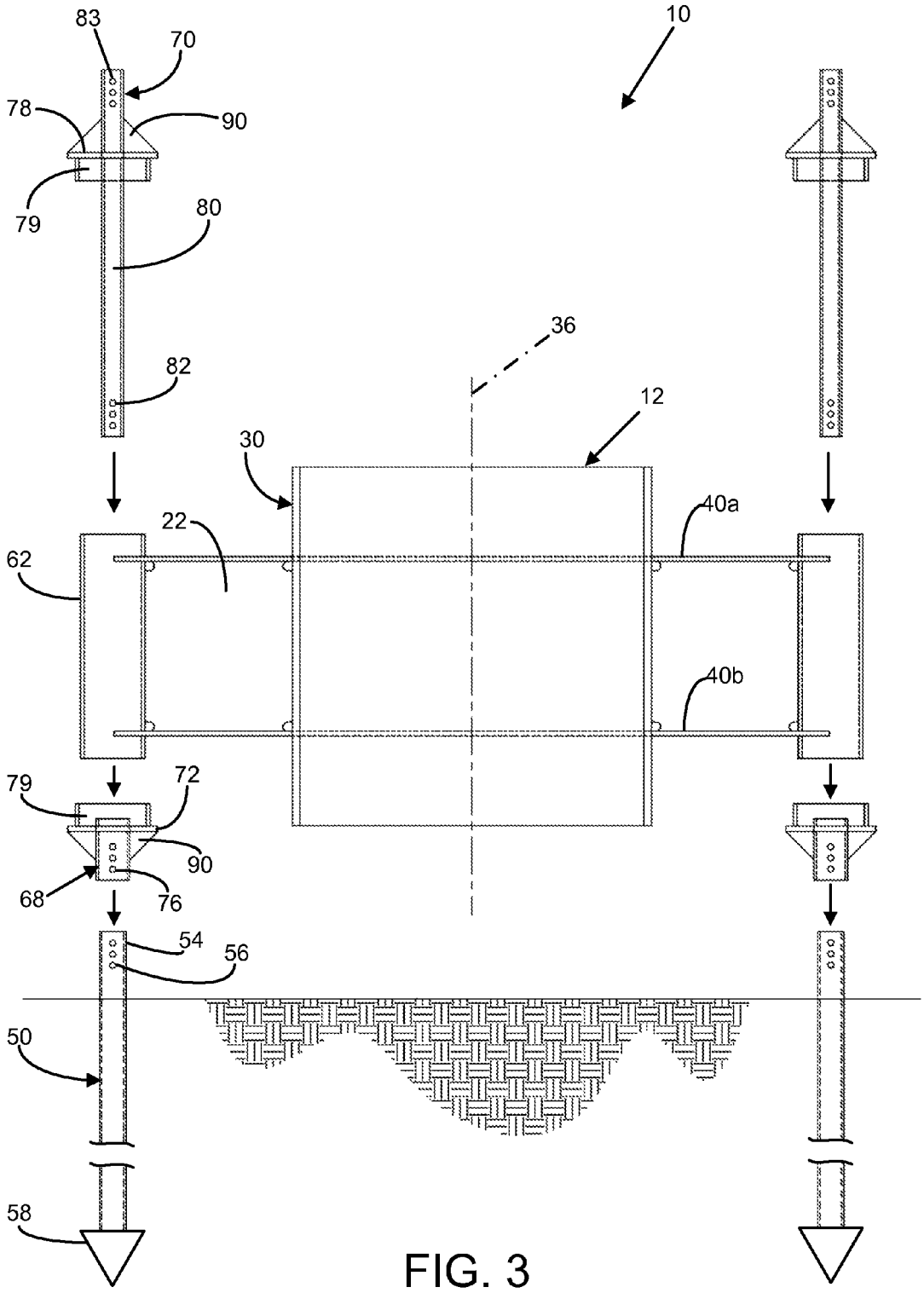
FIG. 3 is an exploded side view of the tower foundation shown in FIG. 2.

Referring to FIG. 3, one representative method of installing the tower foundation 10, e.g., secured it to the ground 52, is shown. The tower foundation 10 can be installed above or at least partially below ground level. In an above-ground installation (see FIGS. 2 and 3), the arms 20 and central support column 30 are positioned above the surface of the ground 52. When installing the tower foundation 10 in this manner, an excavation pit need not be dug in the ground prior to installing the foundation. However, in a below-ground installation where the arms 20 and central support column 30 are completely or partially below ground level, a shallow excavation pit should be formed in the ground prior to installing the tower foundation 10 (see, e.g., FIG. 5).

In most below-ground installation implementations, the depth of the excavation pit is not significantly more than the distance between a lower end 38 of the central support column 30 and a top of the top cap 70. For example, if concealment of the tower foundation 10 is desired, the depth of the exaction pit can be just greater than the distance between the lower end 38 of the central support column 30 and a top of the top cap 70 such that ground components, such as dirt, soil, rocks, etc., or a solidifying agent, such as concrete, grout, etc., can placed on top or over of the foundation to conceal it. However, in some implementations, the depth of the excavation pit can have any of various depths as desired by the user. As used herein, shallow excavation pit can include excavation pits having a depth that is between about 5% and 25% of the depth D of the anchors. In certain implementations, the shallow excavation pit can be between about 3 and about 6 feet. Because the excavation pit is shallow, less debris is removed, shoring is not required, and de-watering is effectively eliminated as shallow pits are not deep enough to reach most water table levels. Therefore, the installation step of removing water with a water-pump truck required by most conventional tower foundations in not required for the installation of the tower foundation 10.

Anchors 50 suitable for the installation site are embedded within the ground such that the attachment end portions 56 of the anchors are above the ground 52 (or at least above the bottom surface of the excavation pit if an excavation pit is desired) and the embedment end portions 58 are secured to desired geological formations proximate the desired depth D. In some implementations, the anchors 50 are torqued, e.g., rotated or screwed, into the ground 52 by a torque motor or similar device until the embedment end portions 58 reach the desired depth D. In other implementations, narrow, upright cylindrical holes are dug into the ground and the anchors 50 are inserted into the holes. A solidifying, shrink-resistant material, such as concrete, mortar, or grout, can then be poured into the holes around the anchors 50 to at least partially secure the anchors to the ground.

The base 12 of the tower foundation 10 can be used as a template for facilitating proper placement of the anchors 50 relative to the outer ends 26 of the arms 20. The base 12 can be positioned in the location at which the tower is to be installed. Each anchor 50 is then continuously inserted through a housing 62 of respective anchor attachment systems 60 until properly embedded into the ground 52. In this manner, the housings 62 act as a guide for proper placement and orientation of the anchors 50. Once the anchors 50 are properly embedded into the ground 52, the base 12 can be removed.

The attachment end portions 56 of the anchors 50 are then inserted into the anchor attachment portion 74 of respective lower caps 68 by lowering the lower caps over the anchor attachment portion. The base is then lowered over the lower caps 68 such that each lower cap is aligned with a respective housing 62. The top caps 70 are then inserted into and through respective housings 62, and within the attachment portions 56 of the corresponding anchors 50. The bottom and top caps 68, 70 can be rotated until the apertures 76, 82 are aligned with each other, and aligned with the apertures 54 of the corresponding anchor 50. Once aligned, fasteners (not shown) can be extended through the apertures 76 of the anchor attachment portion 74, the apertures 54 of the anchor 50, and the apertures 82 of the anchor attachment portion 80 and tightened to secure the bottom and top caps 68, 70 to the anchors 50, and the anchors and caps to the base 12.

The length of the anchor attachment portion 80 of the top caps 70 and placement of the apertures 76, 82 are such that when the bottom and top caps 68, 70 are secured to each other, the sealing portions 72, 78 of the bottom and tom caps contact the bottom and top ends 64, 66 of respective housings 62 to effectively seal the bottom and top ends of the housings. In some implementations, just prior to securing the top cap 70 to the bottom cap 68, a solidifying, shrink-resistant material, such as grout, can be poured into the space 63 between the housing and the anchor attachment portion 80. In some implementations, at least one of the sealing portions 72, 78 can include a coverable hole through which the solidifying material can be injected into the space 63 after the bottom and top caps 68, 70 are secured to the anchors 50 and housings 62. The effective seal achieved by the sealing portions 72, 78 acts to contain the solidifying material within the space 63 of the housings 62. As the material hardens, it acts to improve the connection between the housing 62, caps 68, 70 and anchors 50. Further, the solidifying material can act to resist rotation of the anchors 50 after they are properly embedded within the ground 52. As used herein, the seals created by the caps are not limited to hermetical seals, but can include partial seals, such as seals sufficient to prevent larger materials from entering the housing but may allow smaller materials to enter the housing.

The anchor attachment system 60 is designed to accommodate tilting or angling of the anchors 50. As the anchors 50 are embedded within the ground 52, they may have a tendency to angle inward or outward relative to vertical due to the installation site geology or the installation technique. In some implementations, the anchors 50 are desirably embedded within the ground in a vertical orientation, e.g., parallel to the support column central axis 36 (see FIG. 2), but may inadvertently tilt during installation. Alternatively, in certain implementations, the anchors may be desirably embedded within the ground at an angle relative to vertical. Whether the anchors 50 are advertently or inadvertently embedded within the ground at an angle, the anchor attachment system 60 allows for such angling.

Because of the coupling between the bottom and top caps 68, 70 and the respective anchors 50, any angling of the anchors causes a corresponding angling of the anchor attachment portions 74, 80. Therefore, to accommodate angling of the anchors 50, the anchor attachment system 60 should also accommodate angling of the anchor attachment portions 74, 80. To accommodate tilting of the anchors 50 and anchor attachment portions 74, 80, the inner diameter of the housing 62 is significantly larger than the outer diameter of the anchor attachment portion 80 of the top cap 70. Accordingly, there sufficient room within the space 63 of the housing 62 for the anchor attachment portion 80 to be angled with respect to a central axis (not shown) of the housing 62 and remain within the space. To facilitate a seal between the sealing portions 72, 78 and the bottom and top ends 64, 66 of a respective housing 62 when an anchor is angled with respect to the housing, the sealing portions 72, 78 can include lips 79 extending about a periphery of the sealing portions to capture solidifying material poured into the housing 62, thus maintaining a proper bearing at the seals.

Although the bottom cap 68 is shown below the housing 62 and the top cap 70 is shown above the housing, in some implementations, the bottom and top caps can be reversed if desired. As shown, the top cap 70 includes a second of set apertures 83 positioned proximate an end of the top cap opposite the end of the top cap at which the apertures 82 are approximately located. The top caps 70 can be coupled to the anchors 50 by aligning and fastening the apertures 83 with the apertures 76 of the anchors. The housings 62 of the base 12 can then be lowered over respective anchor attachment portions 80 of the top caps 70. The bottom cap 68 can be coupled to the top cap 70 by aligning and fastening the apertures 76 of the bottom cap with the apertures 82 of the top cap. In this manner, the sealing portion 72 of the bottom cap 68 effectively seals the top end 66 of the housing 62 and the sealing portion 78 effectively seals the bottom end 64 of the housing.

In some implementations, a moisture-resistant material can be poured over or coated on the base 12 and caps 68, 70 to protect the components of the tower foundation 10 from moisture. The moisture-resistant material can be any of various materials known in the art, such as, for example, asphaltic sealant, paint and concrete. Alternative to, or in addition to, a moisture-resistant material, the components of the tower foundation 10 can be galvanized to protect them against the negative effects of moisture.

In several preferred embodiments, the tower foundation 10 is installed without a concrete cap or pouring concrete over the foundation. As described above, conventional tower foundations having large concrete caps or embedments often require a waiting period of about 3-4 weeks after the pouring of the concrete before the support column and supported structure are secured to the foundation. Because the tower foundation 10 does not include a concrete cap or covering in preferring embodiments, the waiting period required to allow the concrete to set is eliminated and the entire tower, including support column and supported structure can be installed at one time, e.g., in a single day.

After installation, the tower foundation 10, according to some embodiments, is configured for easy removal and reuse, such as at another location. As described above, after installations, structural elements of a tower foundation may fail or the tower foundation may no longer be needed in a particular location. In one particular implementation, the tower foundation 10 is removed by decoupling the bottom caps 68 from the anchors 50, e.g., by removing the fasteners, and lifting the base 12 and caps 68, 70 away from the anchors. The anchors 50 can be rotated in a loosening direction using, for example, the same device used to install the anchors. The base 12, caps 68, 70, and anchors 50 can then be moved to a different installation site and reinstalled.

Because the top caps 70 are coupled to the anchors 50 via the bottom caps 68, rotation of the top caps 70 also rotates the anchors 50. Therefore, if the base 12 has been moved (e.g., tilted, raised, lowered, shifted) due to the extraneous factors, such as movement in or shifting of the ground, large overturning forces, etc., the anchors 50 can be adjusted after installation by rotating the top cap 70 to adjust the orientation base 12 if necessary. In certain implementations, this can be accomplished using the same device, e.g., torque motor, used to install the anchors 50.

Figure 4:
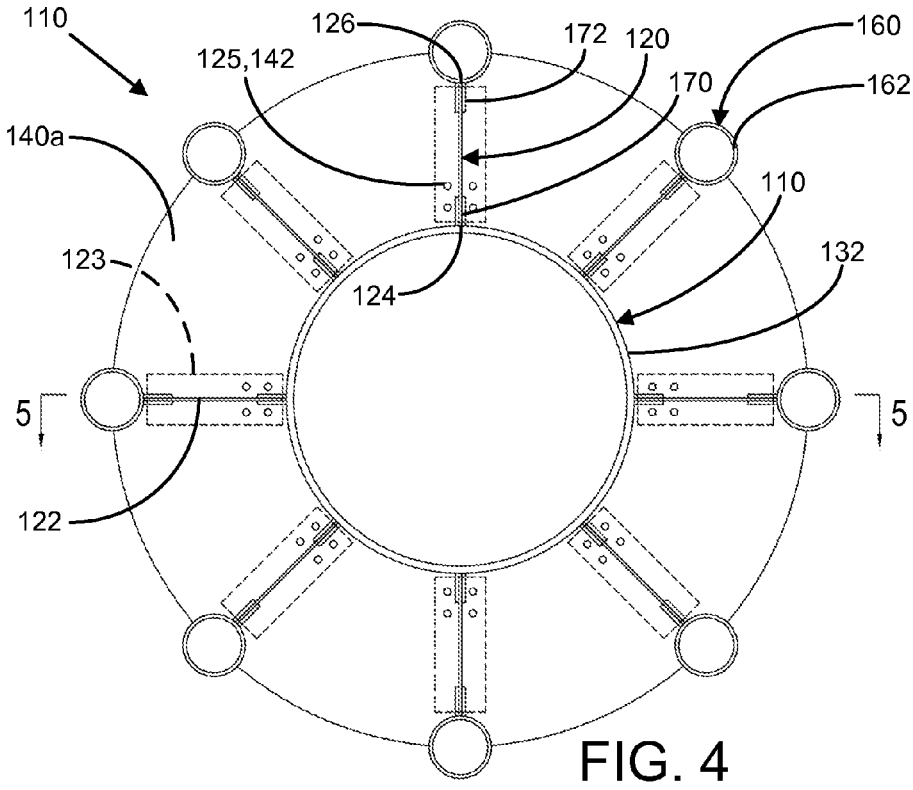
FIG. 4 is a top plan view of a tower foundation according to another representative embodiment.
Figure 5:
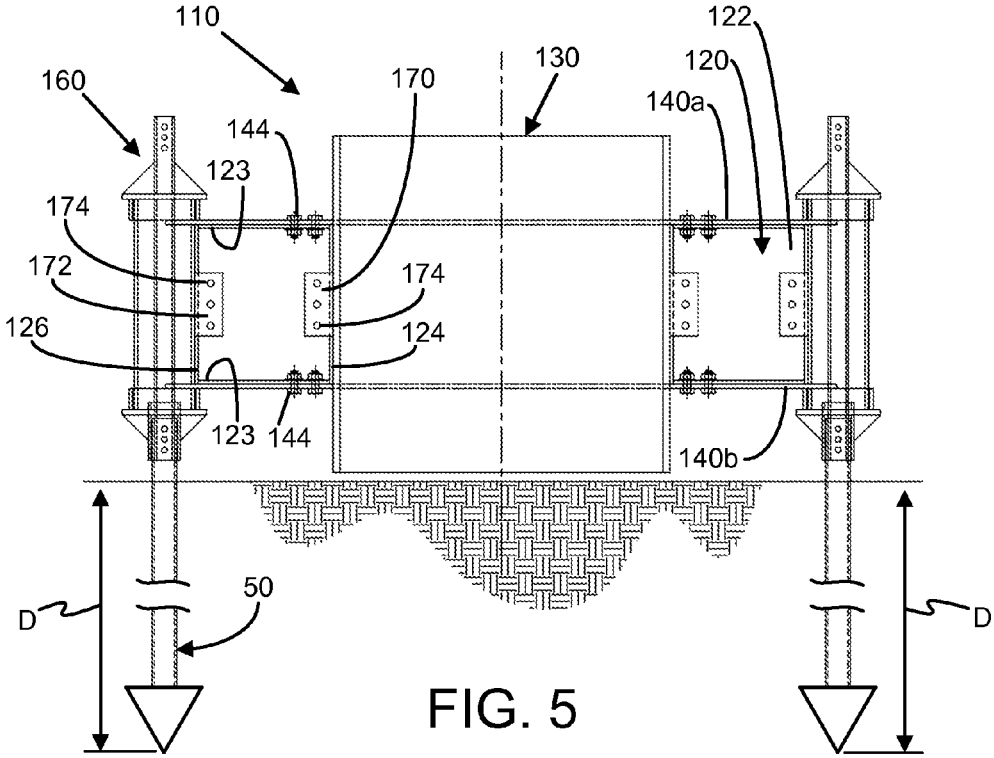
FIG. 5 is a cross-sectional side elevation view of the tower foundation of FIG. 4 taken along the line 5-5 of FIG. 4.

Referring to FIGS. 4 and 5, a tower foundation 110 similar to tower foundation 10 is shown. Like the tower foundation 10, the tower foundation 110 includes arms 120 secured to and extending radially from a central support column 130. The arms 120 are each secured to the central support column 130 at first inner ends 124 and coupled to anchor attachment systems 160 at second outer ends 126. As shown, the first inner ends 124 of the arms 120 are at least partially secured to the central support column 130 and the second outer ends 126 are at least partially secured to the housing 162 of a respective anchor attachment system 160 by brackets 170, 172, respectively. The brackets 170, 172 can be welded to the support column 130 and housings 162, respectively, and fastened to the arms 120 with fasteners 174 or weldments. The brackets 170, 172 can each have a pair of vertical portion flanges between which a vertical portion 122 of a respective arm 120 is secured.

The arms 120 can be I-beams that have two horizontal portions 123 between which the vertical portion 122 extends. Each horizontal portion 123 of the arms 120 includes a set of apertures 125. Alternatively, in certain implementations, the arms 120 can be beams of other shapes, such as tube steel having a circular, square or rectangular cross-sectional shape, with apertures similar to apertures 125.

Similar to tower foundation 10, the tower foundation 110 includes a pair of vertically spaced-apart stiffener plates 140*a*, 140*b* secured to the outer surfaces of the housings 162 and the outer surface 132 of the support column 130. The stiffener plates 140*a*, 140*b* can be secured to the housings 162 and support column 130 by using any of various coupling techniques, such as welding. The stiffener plates 140*a*, 140*b* each include sets of apertures 142 alignable with the apertures 125 of the horizontal portions 123 of the respective arms 120. Accordingly, the arms 120 can be further secured to the support column 130 and housings 162, and the stiffener plates 140*a*, 140*b* can be secured to the arms 120, by extending fasteners, such as fasteners 144, through the apertures 125, 142 and tightening the fasteners against the stiffener plates and arms (see FIG. 5).

The anchor attachment systems 160 can be similar to the anchor attachment systems 60 of the tower foundation 10. Alternatively, the anchor attachment system 160 can include elements for facilitating any of various coupling or fastening techniques known in the art. Similarly, the anchors 150 can be anchors similar to anchors 50 described above or alternatively, can be any of various anchors or piles known in the art.

Like the tower foundation 10, the tower foundation 110 can be installed above the ground, below the ground, or partially below the ground in a manner similar to that described above for the tower foundation 10.

In certain implementations, the tower foundations 10, 110 may also include a stiffener plate (not shown) secured to the inner surface of the support column. The stiffener plate can have a substantially annular shape. The stiffener plate can promote rigidity in and strengthen the support column at the junction between the arms and the column.

Figure 6:
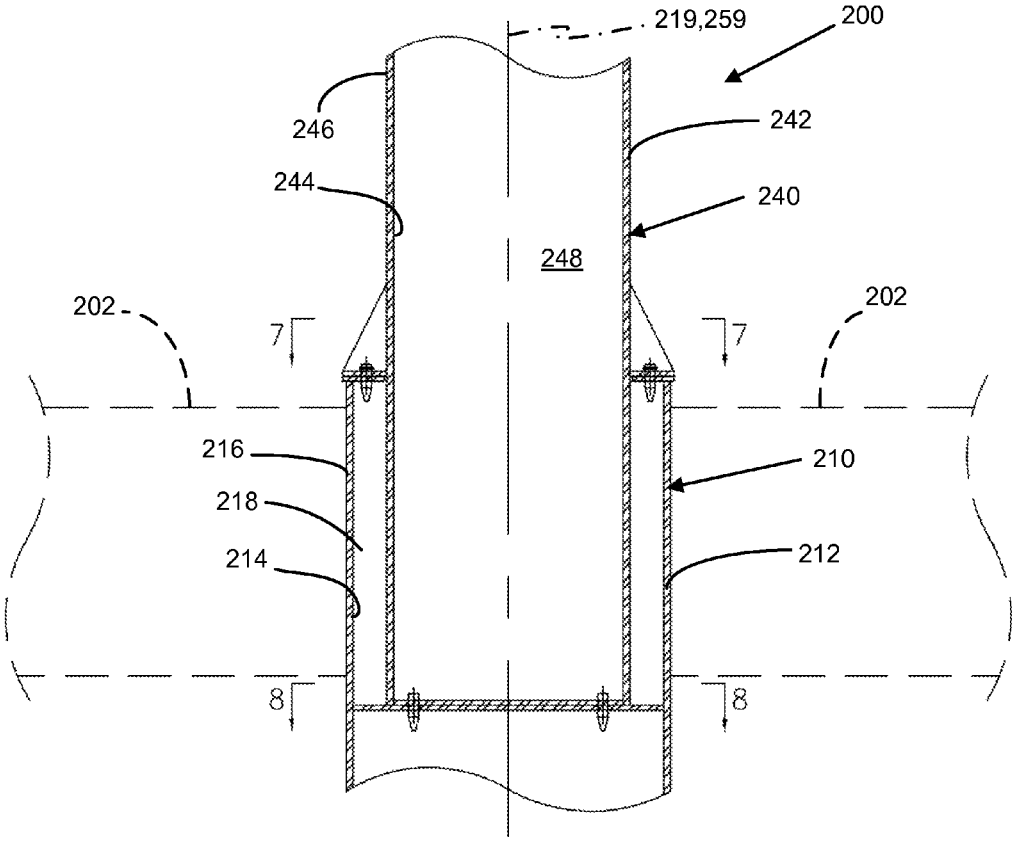
FIG. 6 is a cross-sectional side elevation view of a splice system according to one representative embodiment.
Figure 7:
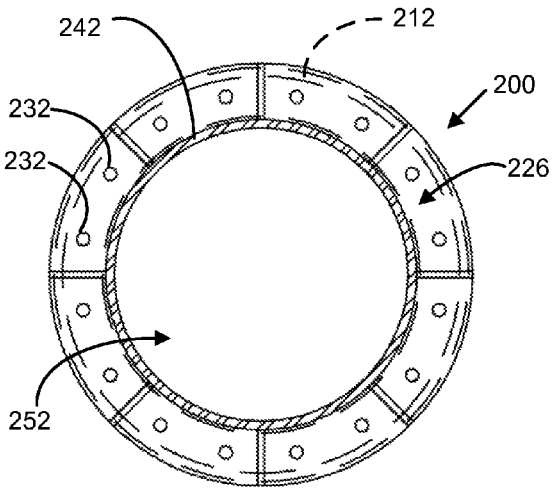
FIG. 7 is a cross-sectional top view of the splice system of FIG. 6 taken along the lines 7-7 of FIG. 6.
Figure 8:
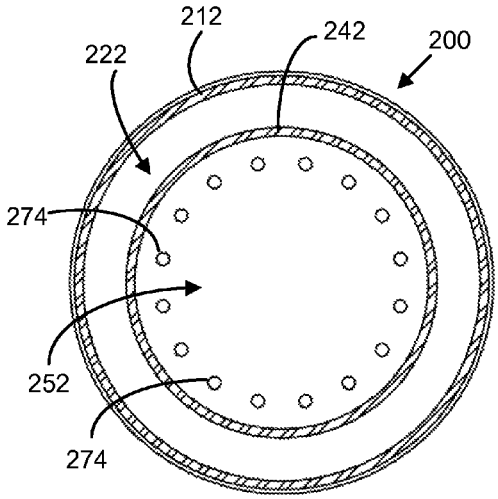
FIG. 8 is a cross-sectional top view of the splice system of FIG. 6 taken along the lines 8-8 of FIG. 6.

Referring now to FIG. 6, a first support column section 210 is shown coupled or spliced to a second support column section 240 according to a representative splicing system 200. The first and second support column sections 210, 240 are two sections of a support column for supporting an above-ground structure. In some implementations, the first and second support column sections 210, 240 together make up the entire support column of the tower. In other implementations, the first and second support column sections 210, 240 can make up two of three or more sections of the entire support column.

The support column sections 210, 240 are substantially tubular or pipe-like members having respective sidewalls 212, 242 that define respective inner surfaces 214, 244 and outer surfaces 216, 246. Each inner surface 214, 244 defines an interior channel 218, 248 extending a length of the respective support column sections 210, 240. The support column sections 210, 240 can have any of various lengths and cross-sections. In the illustrated embodiments, the support column sections 210, 240 have circular cross-sections with the outer surfaces 216, 246 defining outer diameters and the inner surfaces 214, 244 defining inner diameters. The inner and outer diameters can have any of various dimensions. However, the outer diameter of the second support column section 240 is less than the inner diameter of the first support column section 210 such that at least a portion of the second support column section 240 can be inserted within the interior channel 218 of the first support column section. In those implementations having support column sections having non-circular cross-sections, the second support column section should be sized to fit at least partially within the interior channel of the first support column.

Figure 9:
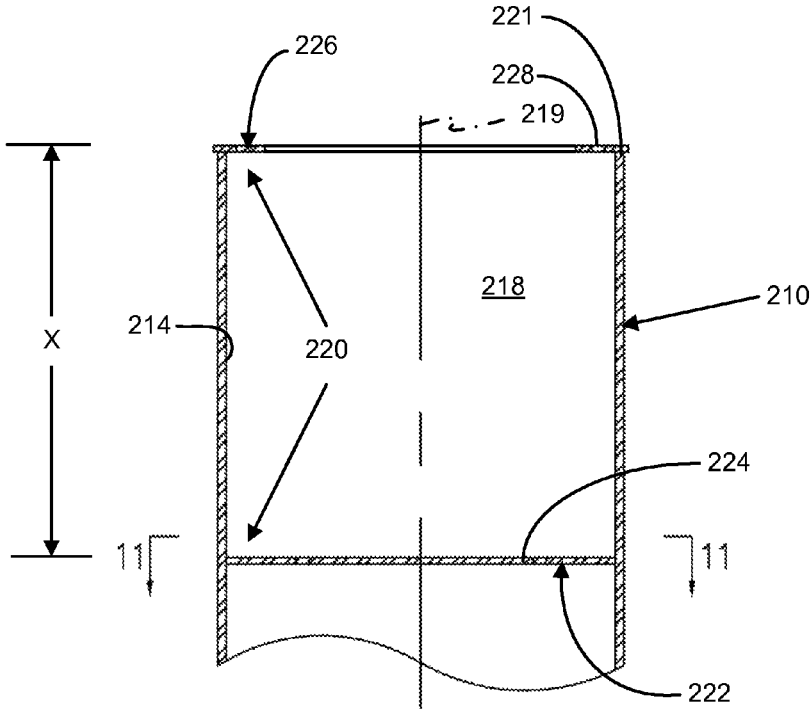
FIG. 9 is a cross-sectional side elevation view of a lower splice portion of the splice system of FIG. 6.
Figure 12:
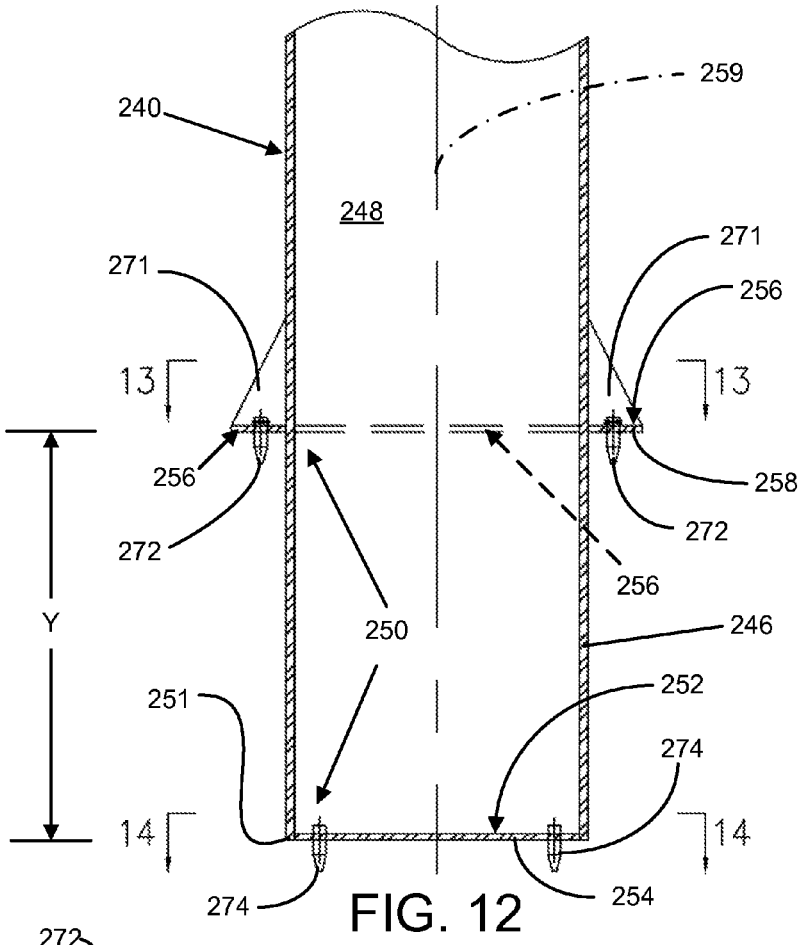
FIG. 12 is a cross-sectional side elevation view of an upper splice portion of the splice system of FIG. 6.

The splicing system 200 includes a first splice portion 220 secured to the first support column section 210 (see, e.g., FIG. 9) and a second splice portion 250 secured to the second support column section 240 (see, e.g., FIG. 12). The first and second splice portions 220, 250 are coupleable to each other to splice together the first and second support column sections 210, 240.

The first splice portion 220 includes a first lower support element 222 having a support surface 224 spaced apart from a first upper support element 226 having a support surface 228. The first lower support element 222 is coupled to the first support column section 210 such that the support surface 224 faces an upward direction and positioned within the interior channel 218. The first upper support element 226 is coupled to the first support column section 210 such that the support surface 228 faces an upward direction with at least a portion of the surface extending inwardly of the inner surface 214. The first lower and upper support elements 222, 226 are positioned relative to each other such that the support surface 224 is positioned a predetermined distance X below the support surface 228. Preferably, the support surfaces 224, 228 extend substantially perpendicular to a central axis 219 of the first support column section 210.

Figure 10:
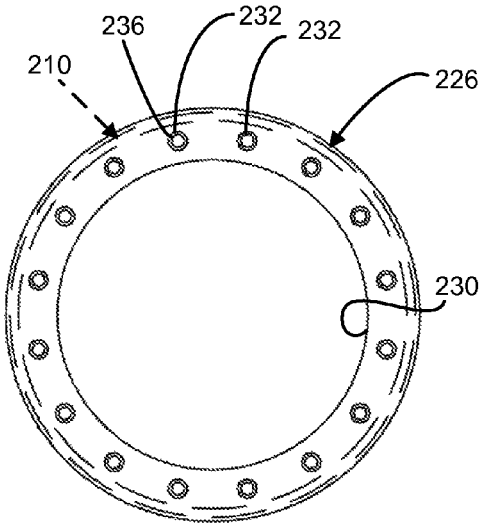
FIG. 10 is a top plan view of the lower splice portion of FIG. 9.
Figure 11:
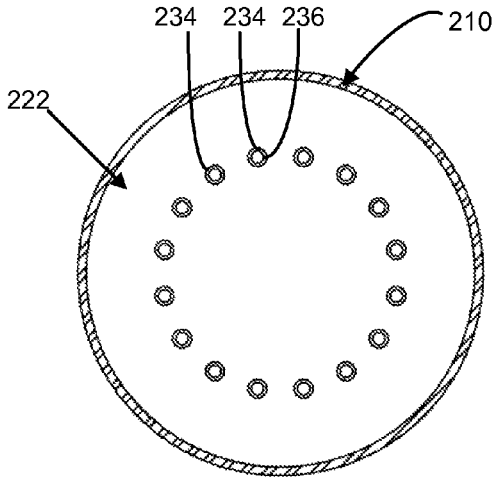
FIG. 11 is a cross-sectional top plan view of the lower splice portion of FIG. 9 taken along the line 11-11 of FIG. 9.

The first lower and upper support elements 222, 226 can have any of various geometries and be secured to the first support column section in any of various ways. As shown in FIG. 11, the first lower support element 222 can be a substantially disk-shaped plate secured to the inner surface 214 of the first support column section 210 such as by welding and positioned within the interior channel 218. As shown in FIG. 10, the first upper support element 226 can be a substantially annular-shaped or ring-shaped plate secured to an upper end 221 of the first support column section 210 such as by welding. Alternatively, the plate of the first upper support element 226 can be secured to the inner surface 214 of the first support column 212 and positioned within the interior channel 218. The first upper support element 226 in the illustrated embodiment has an annular shape that defines a circular aperture 230 with a diameter substantially equal to the diameter of the outer surface 246 of the second support column section 240. However, in other embodiments, the aperture 230 of the first upper support element 226 can be any of various shapes and sizes substantially corresponding to the cross-sectional shape and size of the outer surface 246 of the second support column section 240.

Figure 15:
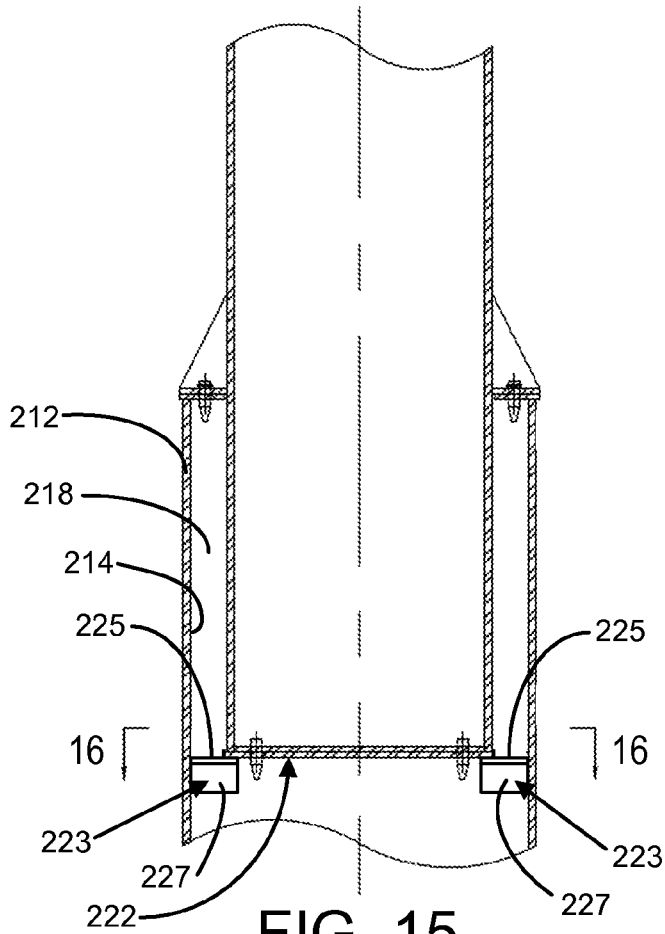
FIG. 15 is a cross-sectional side elevation view of a splice system according to another representative embodiment.
Figure 16:
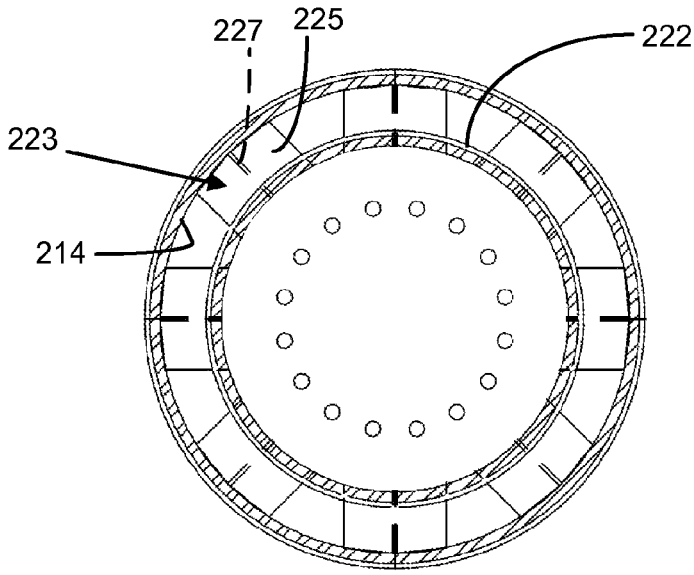
FIG. 16 is a cross-sectional top plan view of the splice system of FIG. 15 taken along the line 16-16 of FIG. 15.

According to one representative embodiment shown in FIGS. 15 and 16, the first lower support element 222 of the first splice portion 220 includes an adjustable feature for accommodating ease in manufacturing and irregularly shaped support columns. In this embodiment, the first lower support element 222 can be sized smaller than the interior channel 218 and secured to the interior surface 214 via shelves 223. The shelves 223 can are secured to the inner surface 214 of the first support column 212 in a spaced-apart manner circumferentially about the inner surface 214 of the first support column. Each shelf 223 extends inwardly away from the inner surface 214 and includes an upright portion 227 and an upwardly facing support surface 225 configured to contact and support the first lower support element 222. For example, the shelves 223 can be substantially "T"-shaped in cross-section and secured to the support column in a substantially upright orientation.

The first lower support element 222 shown in FIGS. 15 and 16 is adjustable because it can be secured (e.g., welded) in place to the shelves 223 in any of various positions within the interior channel 218 of the first support column 212. In practice, circular support columns can be slightly out-of-round, which can make welding the first lower support element 222 directly to the inner surface 214 of the first support column 212 difficult. Moreover, it may be difficult to coaxially align the first lower support element 222 with the central axis 219 of a slightly out-of round first support column 212 when welding the first lower support element 222 directly to the inner surface 214 of the first support column 212. By welding the first lower support element 222 to shelves 223, the first lower support element 222 is not welded directly to the inner surface 214 and thus can be easily coupled to the inner surface 214 and positioned properly, e.g., coaxially, within the interior channel 218 regardless of whether the first support column 212 is out-of-round.

Referring to FIG. 10, the first upper support element 226 includes a plurality of spaced-apart engagement elements, such as apertures 232, positioned circularly about a center of the support element 226. Similarly, as shown in FIG. 11, the first lower support element 222 includes a plurality of spaced-apart engagement elements, such as apertures 234, positioned circularly about a center of the support element 222. The apertures 234 are not shown in FIG. 10. For convenience in installation, as will be explained in more detail below, each of the apertures 232, 234 can include a beveled edge 236 formed in the support surfaces 224, 228.

The second splice portion 250 includes a second lower support element 252 having a support surface 254 spaced apart from a second upper support element 256 having a support surface 258. The second lower support element 252 is coupled to the second support column section 240 such that the support surface 254 faces a downward direction. The second upper support element 256 is coupled to the second support column section 240 such that the support surface 258 faces a downward direction with at least a portion of the surface extending outwardly of the outer surface 246. The second lower and upper support elements 252, 256 are positioned relative to each other such that the support surface 254 is positioned a predetermined distance Y below the support surface 258. In the illustrative embodiment, the distance Y is equal to the distance X. Preferably, the support surfaces 254, 258 extend substantially perpendicular to a central axis 259 of the second support column section 240.

Like the first lower and upper support elements 222, 226, the second lower and upper support elements 252, 256 can have any of various geometries and be secured to the second support column section 240 in any of various ways.

Figure 14:
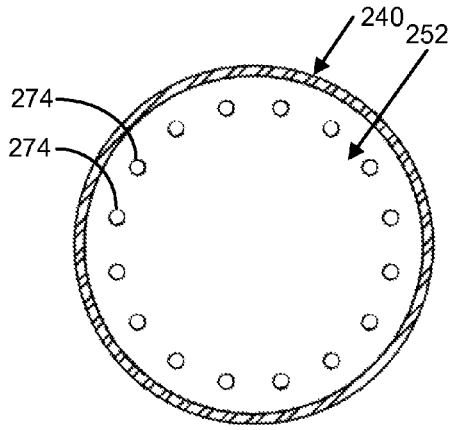
FIG. 14 is a cross-sectional top plan view of the upper splice portion of FIG. 12 taken along the line 14-14 of FIG. 12.

As shown in FIGS. 12 and 14, the second lower support element 252 can be a substantially disk-shaped plate secured to the inner surface 244 (e.g., by welding) proximate a lower end 251 of the second support column section 240. Alternatively, the second lower support element 252 can be secured to the lower end 251 of the second lower support element 252. Preferably, the support surface 254 is approximately flush with or below the lower end 251.

Figure 13:
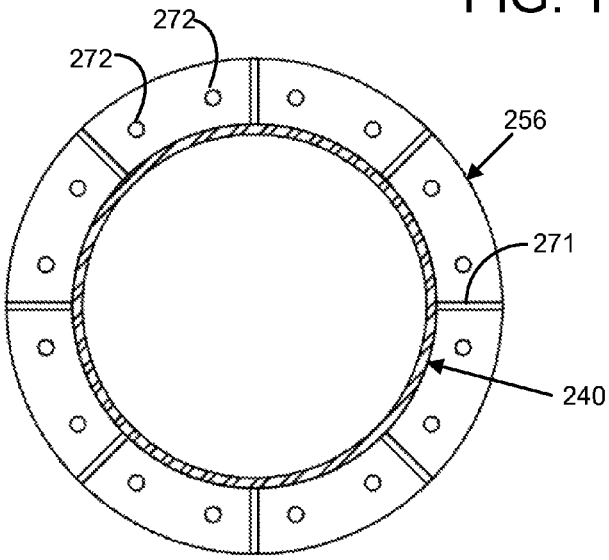
FIG. 13 is a cross-sectional top plan view of the upper splice portion of FIG. 12 taken along the line 13-13 of FIG. 12.

As shown in FIGS. 12 and 13, the second upper support element 256 can be a substantially annular-shaped or ring-shaped plate secured to the outer surface 246 of the second support column section 240 such as by welding. The second upper support element 256 in the illustrated embodiment has an annular shape that defines a circular aperture 270 with a diameter substantially equal to the diameter of the outer surface 246 of the second support column section 240. However, in other embodiments, the aperture 270 of the second upper support element 256 can be any of various shapes and sizes substantially corresponding to the cross-sectional shape and size of the outer surface 246 of the second support column section 240. As shown, the second splice portion 250 can include a plurality of support structures, such as gusset plates 271, spaced apart about a periphery of the second support column section. Each plate 271 is secured to and extends between the second upper support element 256 and the second support column section 240. The plates 271 are each secured to an upper surface 273 of the second upper support element 256 and the outer surface 246 of the second support column section 240. The plates 271 are configured to strengthen the coupling between the second upper support element 256 and the second support column section 240, e.g., stiffen the second upper support element, as well as to facilitate the transfer of vertical loads from the second support column section 240 to the first support column section 210.

Referring to FIG. 13, the second upper support element 256 includes a plurality of spaced-apart engagement elements, such as pegs or pins 272, bars, bolts, etc., positioned circularly about a center of the support element 256 in the same pattern as the engagement elements of the first upper support element 226. Similarly, as shown in FIG. 14, the second lower support element 252 includes a plurality of spaced-apart engagement elements, such as pegs or pins 274, positioned circularly about a center of the support element 252 in the same pattern as the engagement elements of the first lower support element 222. The pegs 274 are not shown in FIG. 13. Each of the pegs 272 are sized and shaped to matingly engage a respective aperture 232 of the first upper support element 226 and each of the pegs 274 are sized and shaped to matingly engage a respective aperture 234 of the first lower support element 222 (see FIG. 6). As shown, the pegs 272, 274 can include a beveled end to facilitate proper engagement with the apertures 232, 234 during installation. Additionally, after engagement between the pegs 272 and apertures 232, locking mechanisms (not shown), such as cotter pins, nuts, or other fasteners, can be coupled to the pegs 272, such as by extending through holes in the pegs 272, to prevent the pegs 272 from becoming disengaged with the apertures 232.

Figure 17:
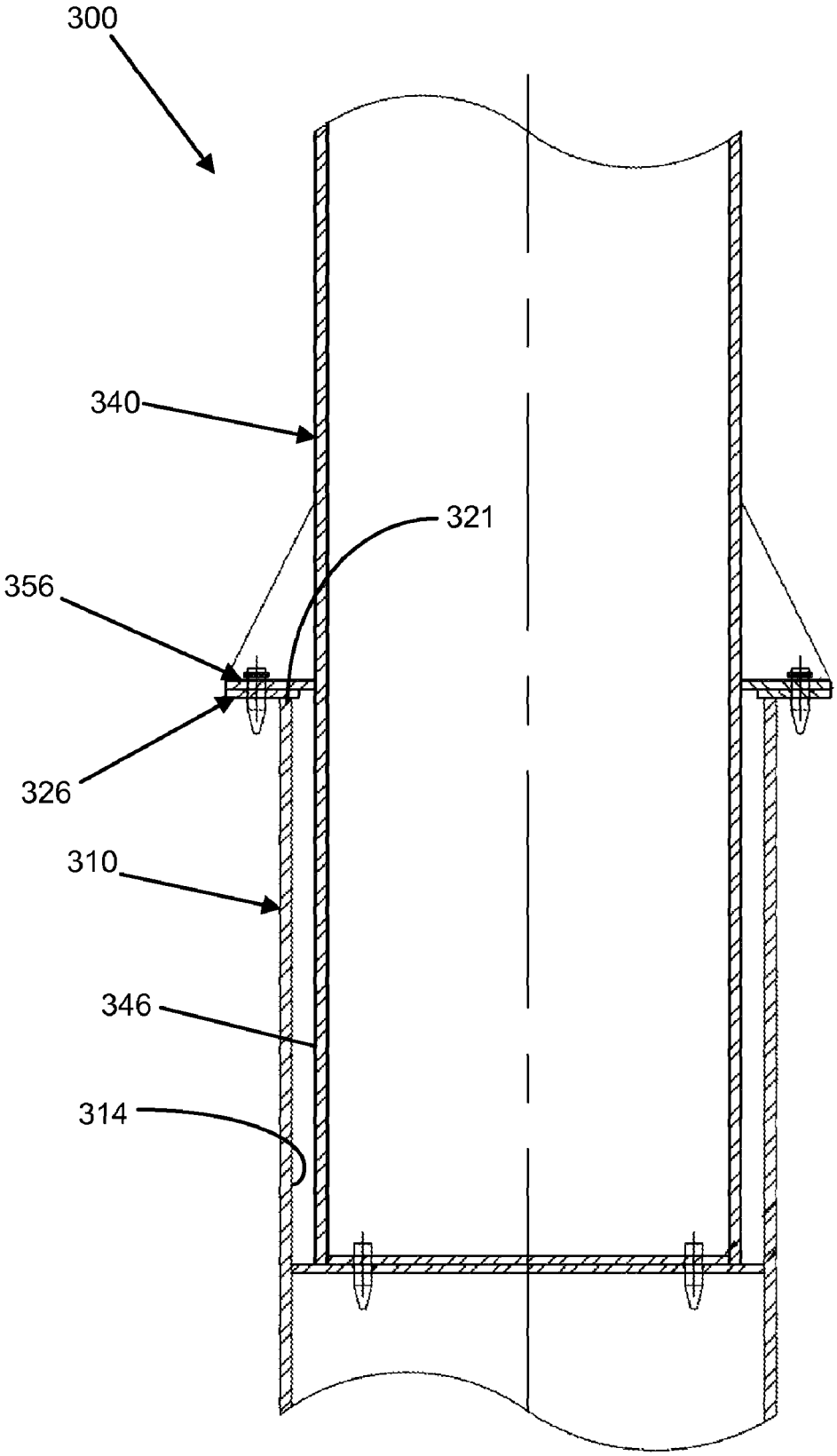
FIG. 17 is a cross-sectional side elevation view of a splice system according to yet another representative embodiment.

Referring to FIG. 17, and according to another embodiment, a splicing system 300 is shown. The splicing system 300 includes many of the same or similar features as splicing system 200 described above except that splicing system 300 is specifically configured for splicing together support columns having an upper support column to lower support column radius difference below a predetermined threshold. For example, in the case of circular support columns 310, 340, as the outer diameter of the upper support column 340 is closer to the inner diameter of the lower support column 310, the clearance between the outer surface 346 of the upper support column and inner surface 314 of the lower support column decreases. Further, as this clearance decreases, the space available for an inwardly directed first upper support element, such as support element 226, also decreases. Accordingly, for the first upper support element 326 to provide an adequate support surface for the second upper support element 356 with smaller upper support column to lower support column radius differences below the predetermined threshold, the first upper support element 326 is secured to the upper end 321 of the lower support column 310 and extends outwardly away from the lower support column. In this manner, two support columns having similar cross-sectional sizes can be spliced together in manner similar to that discussed above in relation to splicing system 200.

In some implementations, the upper support column to lower support column radius difference threshold is approximately 1 foot. However, in other implementations, the radius difference threshold is below approximately 6 inches. It is recognized that one skilled in the art can select a threshold having any of various values based on the particular splicing application being implemented.

According to one representative method of splicing the first and second support column sections 210, 240 together, the second support column section 240, and associated second splice portion 250 is moved, e.g., lowered, relative to the first support column section 210, and associated first splice portion 220, such that the lower end 251 of the second support column section 240 is inserted through the aperture 230 of the first upper support element 226. Preferably, the first and second support column sections 210, 240 are held in a substantially upright orientation, e.g., the axes 219, 259 are substantially vertical, as they are moved relative to each other. The second support column section 240 is further moved relative to the first support column section 210 until the engagement elements of the second support column section 240 engage the engagement elements of the first support section 210. More specifically, in the illustrated embodiment, the second support column section 240 is moved relative to the first support column section 210 until the pegs 272, 274 align with and extend through corresponding holes 232, 234, respectively, and the support surfaces 254, 258 contact and are supported by the support surfaces 224, 228, respectively.

Because the distances X, Y are equal, the support surface 254 of the second lower support element 252 is supported by the support surface 224 of the first lower support element 222 simultaneously with the support surface 258 being supported by the support surface 228. Accordingly, the weight of the second support column section 240 (and any sections or structures supported by the second support column) is distributed to both the first lower and upper support elements 222, 226. Further, the engagement elements of the second upper and lower support elements 256, 252, e.g., pegs 272, 274, remain engaged with engagement elements of the first upper and lower support elements 226, 222, e.g., apertures 232, 234 due to the weight of the second support column section 240 (and other supported sections or structures). Because the weight typically is quite significant, the first and second splice portions 220, 250 remain engaged with each other despite large overturning forces. The first and second splice portions 220, 250 also remain engaged with each other during large overturning forces due to the force transfer between the first and second support column sections 210, 240. As lateral or overturning forces act on the second support column section 240, the forces are transferred to the first support column section 210 at the junction between the first upper and lower support elements 226, 222 via engagement between the pegs 272, 274 and the first upper and lower support elements. Generally, the larger the distance between the first and second lower elements 222, 252 and the first and second upper elements 226, 256, respectively, e.g., distances X and Y, and the number and strength of the pegs 272, 274, the larger the portion of the first support column section 210 to which the overturning forces are initially transferred, and thus the stronger the splice. Accordingly, the distances X and Y, and the number and strength of the pegs 272, 274 can be modified as desired to support a variety of loads.

Once the engagement elements are engaged and the second support column section 240 has rested on the first support column section 210, the column sections are spliced together without welding or tightening together the sections. Accordingly, as opposed to conventional methods of splicing sections of support columns during the installation of towers, the splicing system 200 avoids the time, labor, materials, and complexity commonly associated with welding and fastening at the tower installation site while providing a sufficiently strong and durable splice.

Although in the illustrated embodiments, the holes 232, 234 are formed in the first upper and lower support elements 226, 222, respectively, and the pegs 272, 274 are coupled to the second upper and lower support elements 256, 252, the configuration can be reversed. For example, the holes 232, 234 can be formed in the second upper and lower support elements 256, 252 and the pegs 272, 274 can be coupled to the first upper and lower support elements 226, 222. Further, although the engagement elements are pegs/pins and holes in the illustrated embodiments, in other embodiments, the engagement elements can be elements known in the art, such as clips, hooks, tabs, bolts, etc.

In some embodiments, the support column section 210, like central support column 30, can be part of a tower foundation, such as tower foundation 10. For example, as shown in dashed lines, the support column section 210 can form a portion of a base, such as base 12, and have a plurality of arms 202, similar to arms 20, secured to and radially extending from the support column section 210. In other words, central support column 30 can be replaced with the support column section 210 and associated splicing system 200.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A tower foundation for coupling a tower to the ground, comprising:

a support column having an upper end, a lower end, and an outer surface intermediate the upper and lower ends, the support column extending in a first direction between the upper and lower ends;

a plurality of arms each having a first and second end, each arm being coupled to the outer surface of the support column at the first end and extending radially outward away from the outer surface;

a hollow tubular element coupled to the second end of each of the plurality of arms, the hollow tubular element being circumferentially enclosed;

a plurality of elongate anchors each having an upper end portion and a lower end portion, the upper end portion of each anchor being coupled to the second end of a respective one of the plurality of arms and the lower end portion of each anchor being embeddable within a subterranean geological formation at a location substantially away from the lower end of the support column, wherein the upper end portion of each of the plurality of elongate anchors is coupleable to the hollow tubular element;

an upper plate coupled to an upper portion of at least one of the plurality of arms, at least one of the hollow tubular elements, and the support column, wherein the upper plate extends along the upper portion of the at least one of the plurality of arms from the support column to the at least one of the hollow tubular elements; and a lower plate coupled to a lower portion of at least one of the plurality of arms, at least one of the hollow tubular elements, and the support column, wherein the lower plate extends along the lower portion of the at least one of the plurality of arms from the support column to the at least one of the hollow tubular elements, the upper and lower plates being spaced apart by the at least one of the plurality of arms.

2. The tower foundation of claim 1, wherein a height of the arm is greater than a width of the arm, and wherein the height of the arm extends substantially parallel to the first direction and the width of the arm extends substantially perpendicular to the first direction.

3. The tower foundation of claim 1, wherein each hollow tubular element extends substantially in the first direction.

4. The tower foundation of claim 3, further comprising a plurality of first end caps and second end caps, each of the first end caps being sealingly engageable with a first end of a respective hollow tubular element and each of the second end caps being sealingly engageable with a second end of the respective hollow tubular element; and a plurality of connectors each extending through a respective hollow tubular element between respective first and second end caps to couple the first end cap to the second end cap;

wherein the upper end portion of each of the plurality of elongate anchors is coupleable to a respective first and second end caps via a respective connector.

5. The tower foundation of claim 4, wherein:

each of the hollow tubular elements defines an interior channel having a first cross-sectional area and each of the connectors having a second cross-sectional area; and the first cross-sectional area is substantially larger than the second cross-sectional area such that each connector can be angled relative to the interior channel at any of various angles corresponding to an angle defined between the respective anchor and the first direction.

6. The tower foundation of claim 5, wherein for each hollow tubular element, a space is defined within the interior channel between the connector and an interior wall of the hollow tubular element, the tower foundation further comprising mortar positioned within the space of each hollow tubular element to retain the connectors in place within the interior channels.

7. The tower foundation of claim 1, wherein the upper and lower plates are substantially perpendicular to the first direction.

8. The tower foundation of claim 1, wherein:

the support column comprises a first support column;

the first support column has an inner surface defining a hollow interior, the first support column further comprising a first plate having a plurality of spaced-apart first engagement elements and a second plate defining an aperture and having a plurality of spaced-apart second engagement elements, the first plate being secured to the inner surface within the hollow interior at a location spaced below the upper end and the second plate being secured proximate the upper end; and the plurality of spaced-apart first and second engagement elements are configured to receive a plurality of spaced-apart third and fourth engagement elements of a second support column to splice the first and second support columns together without welding or tightening the first and second support columns together.

9. The tower foundation of claim 1, further comprising at least one upper plate welded to at least a first of the plurality of arms and the support column, and at least one lower plate welded to the first of the plurality of arms and the support column.

10. The tower foundation of claim 1, wherein the support column comprises a first maximum width and the subterranean geological formation is located at a first distance below the ground, and wherein a ratio of the first distance and first maximum width is at least two.

11. The tower foundation of claim 1, wherein the tower foundation resists overturning forces of up to at least approximately 5,000,000 ft-lb.

12. The tower foundation of claim 1, further comprising a single upper plate and a single lower plate, wherein the plurality of arms is positioned between the single upper and lower plates.

13. A tower for supporting a structure above the ground, comprising:

a foundation comprising:

a first support column section having a first sidewall with an inner surface defining a hollow interior and an outer surface, the first support column section further comprising a first plate having a plurality of spaced-apart first engagement elements and a second plate defining an aperture and having a plurality of spaced-apart second engagement elements, the first plate being secured to the inner surface and positioned within the hollow interior and the second plate being secured to the first sidewall at a location above the first plate;

a plurality of arms each having a first and second end, each arm being coupled to the outer surface of the first support column section at the first end and extending radially outward away from the outer surface; and a plurality of elongate anchors each having an upper end portion and a lower end portion, the upper end portion of each anchor being coupled to the second end of a respective one of the plurality of arms and the lower end portion being embeddable within the ground at a location substantially away from the lower end of the first support column section; and a second support column section comprising a second sidewall having a lower end and an outer surface, the second support column section further comprising a third plate having a plurality of spaced-apart third engagement elements and a fourth plate having a plurality of spaced-apart fourth engagement elements, the third plate being secured to the second sidewall proximate the lower end and the fourth plate being secured to the outer surface of the second sidewall at a location above the third plate;

wherein the second support column section is insertable into the hollow interior of the first support column section and through the aperture of the second plate such that (i) the first plate supports the third plate and the second plate supports the fourth plate and (ii) the plurality of spaced-apart third engagement elements each engage a respective one of the plurality of spaced-apart first engagement elements and the plurality of spaced-apart fourth engagement elements each engage a respective one of the plurality of spaced-apart second engagement elements to splice the second support column section to the first support column section.

14. A method for installing a tower used to support a structure above the ground, comprising:

embedding a plurality of elongate anchors having upper and lower end portions into the ground such that the upper end portions are accessible above the ground and the lower end portions are embedded within a subterranean geological formation at a first distance below the ground;

providing a tower foundation comprising (i) a support column having an outer surface intermediate an upper and lower end, (ii) a plurality of arms each having a first and second end, each arm being coupled to the outer surface of the support column at the first end and extending radially outward away from the outer surface, wherein the first distance is below the lower end of the support column, and (iii) a plurality of hollow tubular elements each coupled to the second end of a respective one of the plurality of arms, each of the plurality of hollow tubular elements being circumferentially enclosed; and securing the upper end portions of each of the plurality of elongate anchors to a respective one of the plurality of hollow tubular elements;

wherein the second ends of the plurality of arms each comprises a substantially tubular member having a first upper end and a second lower end; and wherein securing the upper end portions of each of the plurality of elongate anchors to the second end of a respective one of the plurality of arms comprises attaching each upper end portion of the plurality of elongate anchors to one of a plurality of lower cap members, attaching one of a plurality of upper cap members to a respective one of the plurality of lower cap members and the upper end portion of the corresponding attached elongate anchor such that at least a portion of at least one of the upper and lower cap members extends through the respective tubular member, and securing each upper cap member against the upper end of the respective tubular member and each lower cap member against the lower end of the respective tubular member.

15. The method of claim 14, wherein:

the support column comprises a first support column section having a hollow interior, a first plate having a plurality of spaced-apart first engagement elements and a second plate defining an aperture and having a plurality of spaced-apart second engagement elements, the first plate being secured within the hollow interior and the second plate being secured to the first support column at a location above the first plate;

the method further comprises providing a second support column section having an outer surface, the second support column section further comprising a third plate having a plurality of spaced-apart third engagement elements and a fourth plate having a plurality of spaced-apart fourth engagement elements, and the fourth plate being secured to the outer surface of the second support column section at a location above the third plate;

the method further comprises lowering the second support column section into the hollow interior of the first support column section until the (i) the first plate supports the third plate and the second plate supports the fourth plate and (ii) the plurality of spaced-apart third engagement elements each engage a respective one of the plurality of spaced-apart first engagement elements and the plurality of spaced-apart fourth engagement elements each engage a respective one of the plurality of spaced-apart second engagement elements to splice the second support column section to the first support column section.

16. The method of claim 14, further comprising removing soil to form an excavation pit for receiving at least a portion of the tower foundation, wherein the excavation pit has a depth that is between about 5% and about 25% of the first distance.

* * * * *